United States Patent [19]

Kiener et al.

[11] 3,955,339

[45] May 11, 1976

[54] PACKAGE BANDING APPARATUS

[76] Inventors: Josef Kiener; Eugen Lutz, both of Muhlbachstrasse, 8942 Ottobeuren, Germany

[22] Filed: June 17, 1974

[21] Appl. No.: 480,231

[30] Foreign Application Priority Data

June 20, 1973 Germany ..... 2331401

[52] U.S. Cl. ..... 53/198 R; 53/228

[51] Int. Cl.[2] ..... B65B 13/02

[58] Field of Search ..... 53/198 R, 228, 229

[56] References Cited

UNITED STATES PATENTS

| | | | |
|---|---|---|---|
| 2,741,885 | 4/1956 | Allison | 53/198 R |
| 2,925,698 | 2/1960 | Mosey | 53/198 R |
| 3,037,335 | 6/1962 | Smith | 53/198 R |
| 3,097,462 | 7/1963 | Langdon | 53/198 R |
| 3,331,312 | 7/1967 | Leslie | 53/198 R |
| 3,442,734 | 5/1969 | Ericson | 53/198 R |
| 3,470,814 | 10/1969 | Tschappu | 53/198 R |
| 3,596,434 | 8/1971 | Zelnick | 53/198 R |

*Primary Examiner*—Travis S. McGehee
*Assistant Examiner*—John Sipos
*Attorney, Agent, or Firm*—Holman & Stern

[57] ABSTRACT

A banding apparatus for enwrapping an object, or a group of objects, employs a system for tightening the banding material around the object of package which includes a piston-cylinder unit operated by compressed air and an adjustable valve which enables the tightening to be set at variable values to accommodate for different shapes, sizes and deformation characteristics of the object or package.

3 Claims, 2 Drawing Figures

PACKAGE BANDING APPARATUS

BACKGROUND OF THE INVENTION

1. Field of the Invention

This invention relates to banding apparatus of the kind comprising means for supporting at least one object to be enwrapped by banding material, means for feeding banding material to said object, means for enwrapping this object with the banding material fed thereto, and a device for tightening the banding material disposed around said object, the improvement whereby the tightening device comprises a piston-cylinder unit operable by compressed air through a conduit incorporating an adjustable valve disposed around said group.

2. Description of Problem and Prior Art

Banderolling apparatus of this kind is used, inter alia, for wrapping or enfolding one or more objects for sales purposes. It is particularly desirable in sales units of this kind that the banding material shall hold the individual packages or the like firmly so that they cannot be pulled out or inadvertently detached. Usually this can only be achieved if the banding material wrapped around the object or package is pulled taut before being welded, gummed or otherwise fastened.

It is known to effect this tightening by feeding the banding material via a roller with a driving means which is brought into play at the appropriate moment to pull back the banding material in the direction towards its point of introduction and thereby tighten it. The drive in this case is performed through an electric motor and a slip clutch.

Correct tightening creates difficulties when the number or kind of objects which are to be packaged vary. Objects which cannot be deformed are generally dealt with using a greater degree of tightening, but the available length of pull is comparatively small and only a small length of banding material can be pulled. Soft packages, for example stocking packages or the like, permit or require the use of less force. The length of banding material which is to be retracted is, however, usually greater. A driving combination consisting of an electrical motor and a slip clutch can only meet the contrasting demands imperfectly. Accurate adjustment is difficult, especially as the functioning is made variable by continuous and lengthy operation producing heating effects, or because of the appearance of wear.

SUMMARY OF THE INVENTION

The object of this invention is to provide an apparatus for the function set out above which is such as to enable a satisfactory tightening of which can be quickly and easily adjusted to suit particular requirements and will remain undisturbed at a pre-set optimum value even during a long period of operation. This invention is based on an apparatus of the kind set forth above and proposes an arrangement in which the tightening device comprises a cylinder-piston unit operable by compressed air through a conduit which incorporates an adjustable valve.

Satisfactory results are obtained with apparatus as set forth. A particular pressure can be set on the adjustable valve, which in a preferred embodiment of the invention takes the form of an excess pressure valve, and this predetermined pressure can be applied to the cylinder-piston unit. The maximum tension applied is thus predetermined and invariable. When the air pressure is applied the tightening takes place up to a maximum value which can be chosen so that soft packages will not be deformed. Short delays during the tightening operation do not interfere with the functioning. The pressure, which is low at first, will increase later as the compressed air cylinder is filled, and until a pre-set delay is passed.

A decisive advantage of the invention is that it is possible to change quickly and simply from one type of packaged object to another. All that is required is a setting of predetermined value in the adjusting valve. Wear phenomena does not vary the effectiveness of the pre-set value.

The invention can be implemented by having the cylinder-piston unit act on at least one tightening roller in contact with the banding material.

In a proven embodiment of the invention the cylinder-piston unit acts on a driving wheel of large diameter which operates a tightening roller of smaller diameter through a toothed gearing. If it is possible to obtain a comparatively smaller angle of adjustment by the use of a cylinder-piston drive which operates a toothed wheel serving as a crank, this construction arrangement makes it very simple to achieve a complete rotation of the tightening roller, or in some circumstances even more, when this appears to be necessary to effectively perform the tightening operation.

An embodiment of the invention is diagrammatically illustrated in the accompanying drawings, in which:

DESCRIPTION OF THE PREFERRED EMBODIMENT

Figure 1:
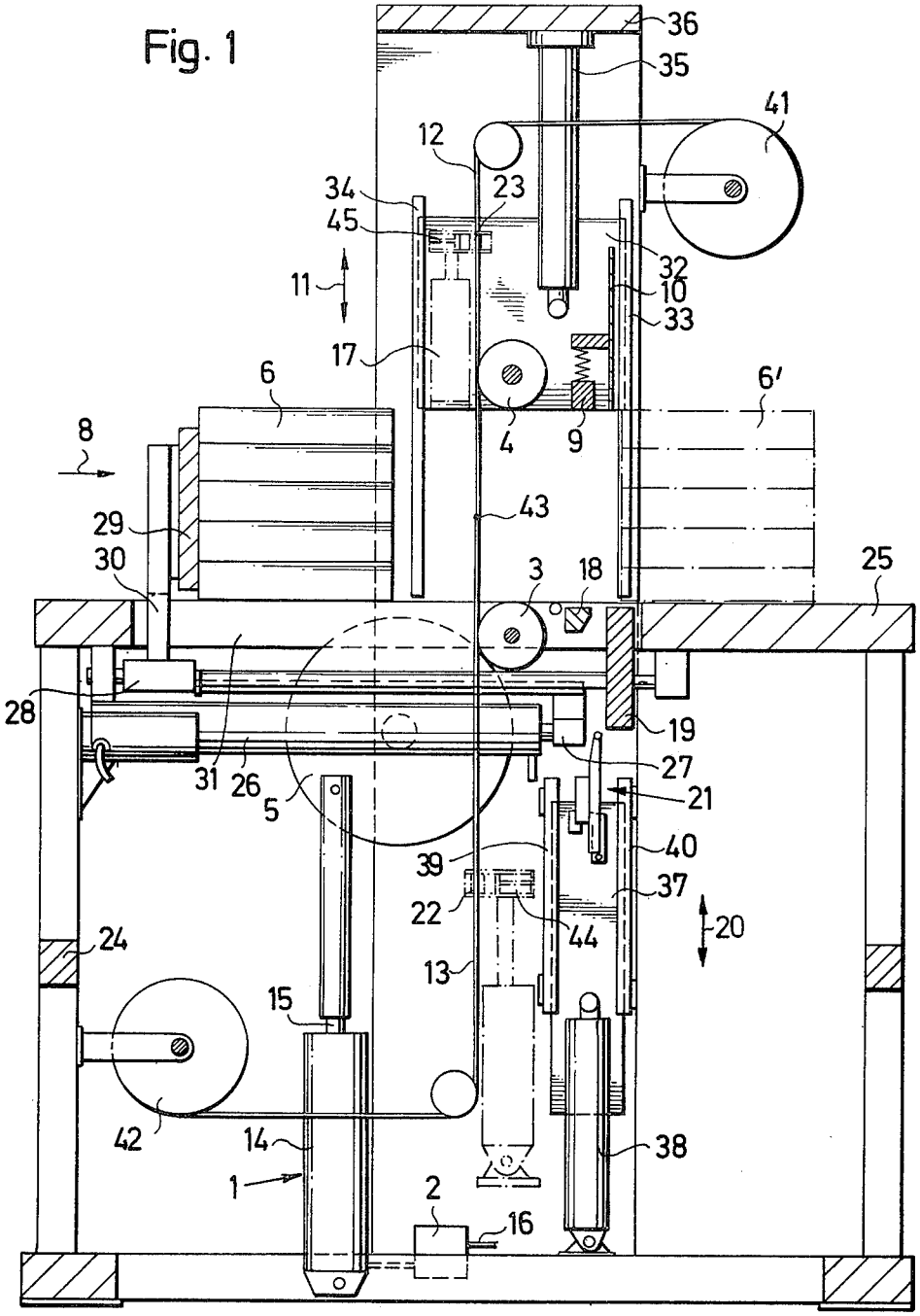
FIG. 1 is a front view, partly in section, of a banding machine according to the invention.

The banding apparatus illustrated in FIG. 1 comprises a machine frame 24 with a table 25. Mounted in frame 24 is a piston-cylinder unit 26, the piston rod 27 of which operates a shifter 28 acting on a pusher plate 29 through the agency of a bar 30 projecting through a slot 31 in table 25. The pusher plate 22 is used to move the stack of objects 6, to be banded into a package on table 25, to the position shown in chain dotted lines at 6' in FIG. 1.

A slide 32 arranged above the table and laterally of the path of travel of the objects 6 is movable on rails 33 and 34 in the directions indicated by the double arrow 11. This slide 32 is operated by a piston-cylinder unit 35 which is engaged with slide 32 and bears against part 36 of frame 24. Slide 32 carries a roller 4 and clamps 9 and 10. Clamp 9 is resiliently mounted.

A further slide 37 is movable beneath the table 25 on the machine frame and is moved by a piston-cylinder unit 38 on rails designated 39 and 40. A welding device 21 is secured to slide 37 by clamping means.

Two supply reels 41 and 42 for banding material are mounted on the machine frame 24. The banding parts from these reels are respectively designated 12 and 13 and these are connected at 43 by welding. The weld 43 is produced during a banding operation as will be more specifically described hereafter.

A tightening roller 3, similar to roller 4, is mounted on the machine frame and can be driven by a wheel 5. The wheel 5 is operated by the piston-cylinder unit 1, the piston rod 15 of cylinder 14 turns driving wheel 5 and thus the tightening roller 3. Compressed air is supplied to piston-cylinder unit 1 through a compressed air conduit 16 which incorporates an excess pressure or relief valve 2.

If so desired, in addition to the piston-cylinder unit 1 with its cylinder 14 and piston rod 15, and to the operating wheel 5, a further piston-cylinder unit 1', shown in chain dotted lines, can be mounted on the machine frame 24, the piston rod of this further unit carrying a clamping device 22 which is operated by a small piston-cylinder unit 44 which is movable with the piston rod of the assembly 1'.

If so desired, an assembly 17 similar to the piston-cylinder unit 1' can be mounted on slide 32 and this, like piston-cylinder unit 1', is shown with its associated equipment in chain dotted lines. The piston rod of this unit 17 carries a small piston-cylinder unit 45 which operates a clamping device 23. Whilst the unit 1', which is optional, acts on the band part 13, the unit 17 and its clamping device 23 act on the band part 12.

With the objects 6 stacked as illustrated in FIG. 1 and ready for banding, the unit 26 is operated to bring about a forward shift in the direction of arrow 8. The stack shown in chain dotted lines in FIG. 1 and moved to the position 6' takes with it the two parts 12 and 13 of the banding material, now connected at the weld 43.

The width of the banding material needs to be suited to the width of the stack of objects 6 but can be substantially narrower than that of the objects. It will be apparent that, during the shifting of the objects by means of the plate 29, the parts of the band can be wound off or drawn off both from reel 41 and from reel 42. Immediately following the termination of this advancing motion the pusher plate 29 returns to its starting position leaving the objects in their new position 6'.

Figure 2:
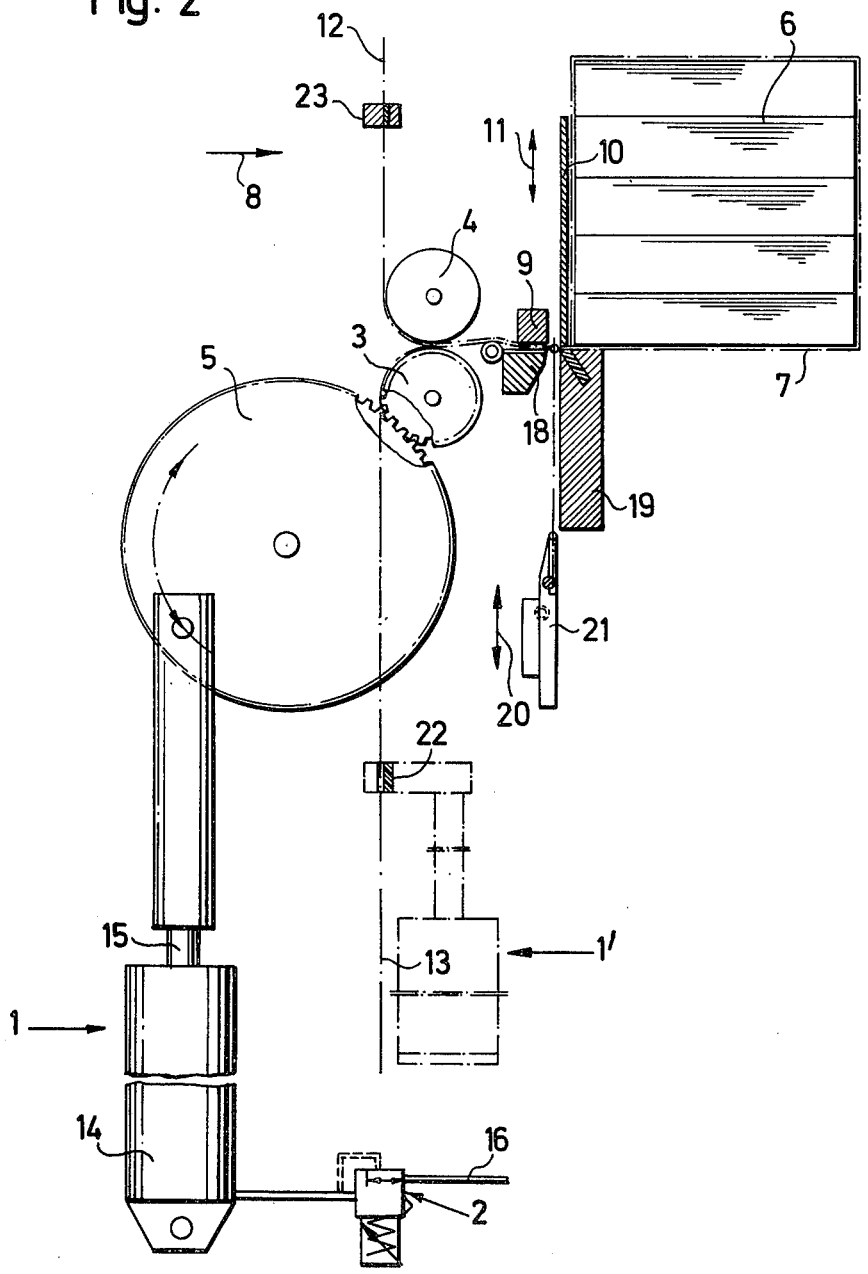
FIG. 2 is an illustration of parts of the machine of FIG. 1 in another operative position and shown on a larger scale.

The piston-cylinder unit 35 is now operated to move the slide 32 downwards in the direction of arrow 11. The roller 4 and a clamping jaw 9, which extends substantially over the complete width of the banding material, pulls this material down into the lower position illustrated in FIG. 2. This forms the loop 7 around the objects 6 and closes the neck of this loop.

Clamping jaws 9 and plate 10 are carried by slide 32 and as a result of downward movement of the latter are abutted aganst fixed (abutments) clamping jaws 18 and 19 on the frame 24. Just before this abutment takes place the piston-cylinder unit 1 is operated and the driving wheel 5, which is connected through a toothed wheel drive with the tightening roller 3, tighten the loop 7 in that the part 13 of the banding material is pulled down. The excess-pressure valve 2, which is adjustable, enables the pressure in the piston-cylinder unit 1 to accurately set and as a result there is an upper limit to this pressure. Consequently the tightening roller 3 carries out a predetermined amount of rotation during the tightening procedure and the actual tightening is precisely set.

The arrangement may be so devised that the roller 4 is also operated by a toothed wheel drive to bring about a certain amount of tightening. As a rule, however, it is sufficient for the roller 3 to be relied on for the tightening. Tautening of the band part 12, which runs over roller 4, can also be dispensed with because the movement of slide 32 imparts a certain amount of tensioning to this band part 12 which is not experienced by part 13.

After the tightening operation, the clamping action between clamping jaws 9 and 10 and between 18 and 19 is completed by the slide 32 being moved down fully. The welding device 21 is now raised in the direction of arrow 20 by means of piston-cylinder unit 38 and the welding implemented. This welding is accompanied by a separating operation, the loop 7 formed being simultaneously welded and the weld 43 produced, whilst the loop 7 is separated from the band parts 12 and 13.

After appropriate cooling, the clamps are released. Slide 32 moves back to the starting position illustrated in FIG. 1. The same is true of slide 37. A new working cycle can now commence.

The band parts 12 and 13 are shown as of rectilinear form in FIG. 1. This condition is maintained if a weak uniform pull is continuously applied to the band parts 12 and 13. This however is not absolutely necesssary. The next looping operation would be practicable with a non-tensioned band.

During the next operating cycle the articles which have been bound up are moved forward.

The invention can be modified in various ways. In particular the setting valve 2 may, for example, be in the form of a throttle valve which automatically closes the compressed air supply when a predetermined pressure is arrived at in cylinder 14 of the piston-cylinder unit 1. Again the driving wheel 5 can be replaced by some other driving agency without departing from the scope of the invention.

Instead of operating the tightening roller 3 by means of the driving wheel 5, the invention can be implemented by having the associated piston-cylinder unit act directly on the banding material, that is to say either on the band part 13 or on the band part 12, or simultaneously on both these parts. The piston cylinder unit 1', with its associated means, particularly the clamping arrangement 22, brings about the tightening of the band part 13 by operation of the piston-cylinder unit 44 which holds the band firm, and then operation of the piston-cylinder unit 1' to draw the band towards the supply reel 42.

The piston-cylinder unit 17 with its clamping device 23 and associated arrangement simultaneously grips and tightens, if required, the band part 12.

We claim:

1. In banding apparatus for wrapping a continuous tensioned band about at least one article to form a package, comprising: support means for an article to be banded; means for moving the article in a path along said support means; a pair of supply roller means each carrying a supply of banding material joined to each other by a transverse weld seam, said supply of banding material extending in a path intersecting the path through which said article is moved on the support means, said supply roller means being journaled for free rotation as the banding material is payed therefrom whereby movement of the article on the support surface and through the path intersected by the supply of banding material causes the banding material to be draped about the article being banded; and means for securing the banding material in circumposed, tensioned relation about said article, the improvement in which said last-mentioned means comprises: a pair of rollers disposed transversely in spaced relation relative to the path through which said article is moved at the side of the banding material opposite that toward which the article is moved; means for moving said rollers in juxtaposed relation to substantially pinch the band of material about the article being banded; means for tensioning the band of material draped about the article and pinched by the rollers; means for clamping the band of material while tensioned and retaining it pinched; and means for sealing and severing the band of material while tensioned for forming the continuous band about the article and forming the transverse weld seam in the band for subsequent wrapping operation, said means for tensioning the band of material comprising means for reversing the rotation of one of said rollers, said means including a fluid-pressure-operated, piston-cylinder unit operatively connected to said one roller and adjustable valve means operatively connected to the piston-cylinder unit for controlling the maximum tension that can be directed to the band of material through said one roller to which the piston-cylinder unit is operatively connected.

2. The structure as claimed in claim 1 in which said valve means comprises a pressure-relief valve.

3. The structure as claimed in claim 1 in which said one roller includes a gear element rotatable therewith, said piston-cylinder assembly including a gear wheel meshed with said gear element, said piston-cylinder unit including a piston rod journaled eccentrically to the gear wheel on a pivot axis parallel to the axis of rotation of said one roller whereby reciprocation of the piston rod causes relative rotation of the one roller and tensioning of said band of material.

* * * * *